US008297064B2

(12) United States Patent
Walters

(10) Patent No.: US 8,297,064 B2
(45) Date of Patent: Oct. 30, 2012

(54) ENERGY EFFICIENT AIR CONDITIONING SYSTEM

(76) Inventor: James M. Walters, Hemet, CA (US)

( * ) Notice: Subject to any disclaimer, the term of this patent is extended or adjusted under 35 U.S.C. 154(b) by 0 days.

(21) Appl. No.: 13/166,990

(22) Filed: Jun. 23, 2011

(65) Prior Publication Data

US 2011/0262267 A1 Oct. 27, 2011

(51) Int. Cl.

| | |
|---|---|
| ***F25B 9/00*** | (2006.01) |
| ***F25D 9/00*** | (2006.01) |
| ***F01K 23/06*** | (2006.01) |
| ***F01K 25/00*** | (2006.01) |

(52) U.S. Cl. ..... 62/87; 62/402; 60/670; 60/671

(58) Field of Classification Search ..... 62/87, 402, 62/500; 60/670, 671

See application file for complete search history.

(56) References Cited

U.S. PATENT DOCUMENTS

| | | | | |
|---|---|---|---|---|
| 3,196,631 | A * | 7/1965 | Holland | 62/87 |
| 3,628,350 | A * | 12/1971 | Ruth | 62/263 |
| 4,235,080 | A * | 11/1980 | Cassidy | 62/87 |
| 6,698,214 | B2 * | 3/2004 | Chordia | 62/114 |
| 2011/0018278 | A1 | 1/2011 | Tomaini | |

* cited by examiner

*Primary Examiner* — Frantz Jules
*Assistant Examiner* — Daniel C Comings

(57) ABSTRACT

An energy efficient air conditioning system preferably includes a compressor, a reaction turbine, an electrical generator, an expansion device, an evaporator coil, an evaporator fan and a refrigerant gas. A condenser coil and fan are replaced with the reaction turbine. Hot high pressurized gas is piped into the reaction turbine from the compressor, which causes a drive shaft of the reaction turbine to spin the electrical generator. High pressurized liquid exits the reaction turbine into the expansion device as a high pressure liquid. A low pressure liquid exists at an output of the expansion device and enters the evaporator coil. The low pressure liquid boils, absorbing heat in the evaporator. The evaporator fan blows warm air from a confined space over the evaporator coil to provide a flow of cold air to the confined space. The low pressure gas then enters the compressor to start a new cycle.

16 Claims, 2 Drawing Sheets

ENERGY EFFICIENT AIR CONDITIONING SYSTEM

BACKGROUND OF THE INVENTION

1. Field of the Invention

The present invention relates generally to air conditioning systems and more specifically to an energy efficient air conditioning system, which uses heat generated in the air conditioning process to generate electrical power to partially power the air conditioning system.

2. Discussion of the Prior Art

Air conditioning systems are designed to remove heat and humidity from buildings and to send the unwanted heat into the atmosphere. However, it is desirable to convert the unwanted heat into electrical power to be used to partially supply the power needs of the air conditioning system. Patent publication no. 2011/0018278 to Tomaini discloses a device and method for capturing energy from building systems.

Accordingly, there is a clearly felt need in the art for an energy efficient air conditioning system, which uses heat generated in the air conditioning process to generate electrical power to partially power the air conditioning system.

SUMMARY OF THE INVENTION

The present invention provides an energy efficient air conditioning system, which uses heat generated by the air conditioning process to generate electrical power to partially power the air conditioning system. A prior art air conditioning system includes a compressor; a condenser coil and fan; an expansion device; an evaporator coil and fan; and a refrigerant gas. A low pressure (refrigerant) gas is compressed in the compressor, which produces a hot high pressure (refrigerant) gas. The hot high pressure gas is cooled to a warm high pressure (refrigerant) liquid by blowing outdoor air through the condenser coil with the condenser fan. The warm high pressure liquid may be stored in an accumulator or drier. The expansion device separates the high pressure side of the air conditioning system from a low pressure side of the air conditioning system. Refrigerant evaporation and boiling will occur in the evaporator as temperature within a confined space is higher than the refrigerant's sub-zero boiling temperature. The evaporating refrigerant liquid at low pressure in the evaporator will absorb warm air from the confined space, building or the like and produce cooled air. The cooled air is blown through the confined space, building or the like by the evaporator fan.

An energy efficient air conditioning system includes the compressor; a reaction turbine; an electrical generator; the expansion device; and the evaporator coil and fan. The condenser coil and fan are replaced with the reaction turbine. The hot high pressurized gas is piped into the reaction turbine, which causes a drive shaft of the reaction turbine to spin the electrical generator. High pressure liquid exits the reaction turbine. The high pressurized liquid enters the expansion device.

Accordingly, it is an object of the present invention to provide an energy efficient air conditioning system, which uses heat generated in the air conditioning process to generate electrical power to partially power the air conditioning system.

These and additional objects, advantages, features and benefits of the present invention will become apparent from the following specification.

DETAILED DESCRIPTION OF THE PREFERRED EMBODIMENTS

Figure 1:
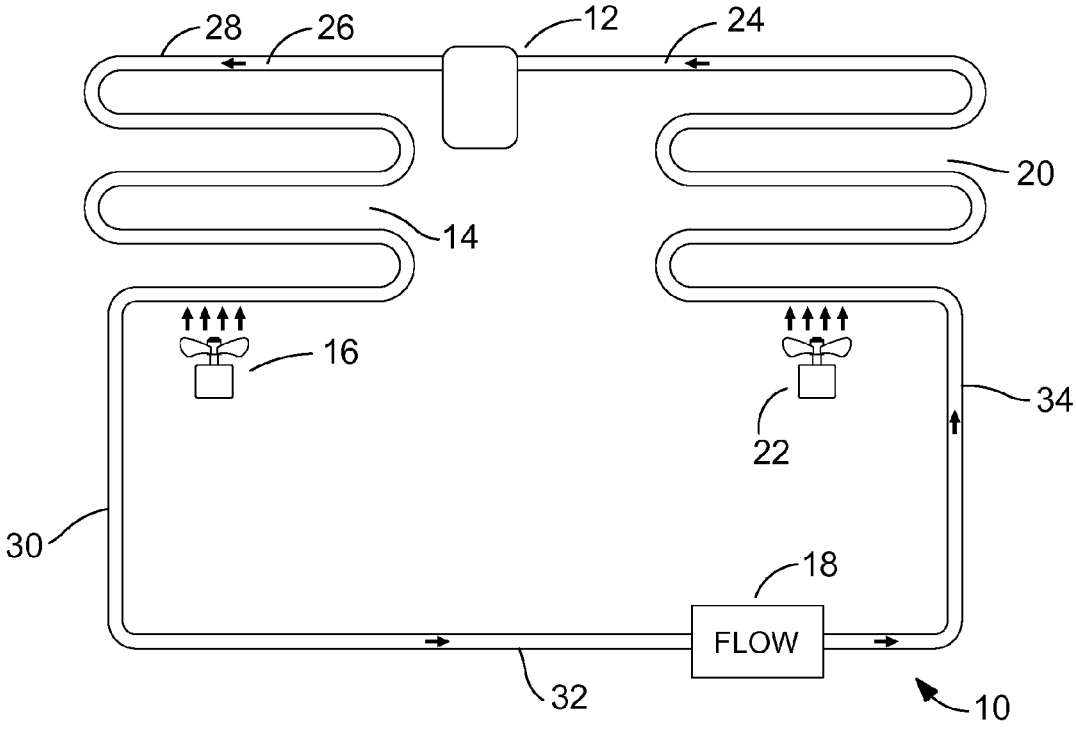
FIG. 1 (PRIOR ART)
FIG. 1 is a schematic diagram of a prior art air conditioning system.
Figure 2:
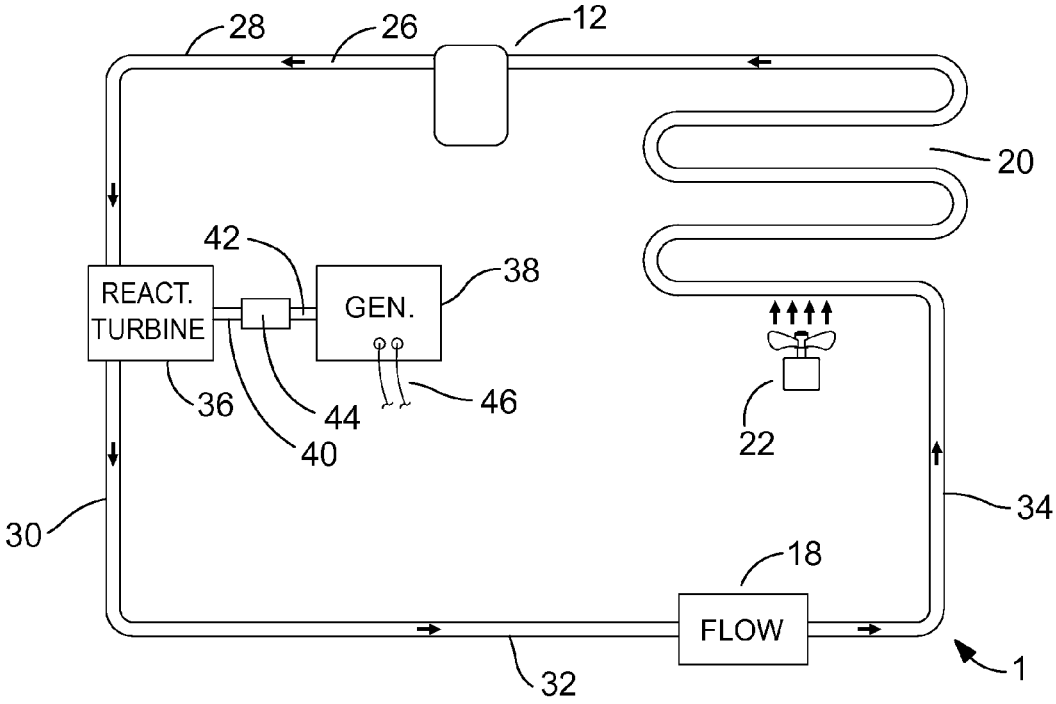
FIG. 2 is a schematic diagram of an energy efficient air conditioning system in accordance with the present invention.

With reference now to the drawings, and particularly to FIG. 2, there is shown a schematic diagram of an energy efficient air conditioning system 1. With reference to FIG. 1, a prior art air conditioning system 10 includes a compressor 12; a condenser coil 14, a condenser fan 16, an expansion device 18, an evaporator coil 20, evaporator fan 22 and a refrigerant gas. A low pressure gas 24 is compressed in the compressor 12, which produces a hot high pressure gas 26. The hot high pressure gas 26 is piped from an output of the compressor 12 to the condenser coil 14 through a high pressure gas line 28. The high pressure gas 26 is cooled to a warm high pressure liquid 30 in the condenser coil 14 by the condenser fan 16. The high pressure liquid 30 is piped to a high pressure side input of the expansion device 18 from the condenser coil 14 through a high pressure liquid line 32. The expansion device 18 separates a high pressure side of the prior art air conditioning system 10 from a low pressure side thereof. A low pressure liquid 34 is produced on a low pressure side of the expansion device 18. One end of the evaporator coil 20 is connected to a low pressure side output of the expansion device 18. Heat from a building or the like is absorbed by the evaporator coil 20. The evaporator fan 22 blows air across the evaporator 20 to produce a flow of cold air in the building or the like. The other end of the evaporator coil 20 is connected to a low pressure side input of the compressor 12. Air conditioning systems are well known in the art and need not be explained in further detail.

An energy efficient air conditioning system 1 preferably includes the compressor 12, a reaction turbine 36, an electrical generator 38, the expansion device 18, the evaporator coil 20, the evaporator fan 22 and the refrigerant gas. It is preferable to use a reaction turbine, but other types of turbines could also be used. A description of a reaction turbine is provided in U.S. Pat. No. 5,735,665 to Kang. U.S. Pat. No. 5,735,665 is hereby incorporated by reference in its entirety. The condenser coil 14 and the condenser fan 16 are replaced with the reaction turbine 36. The hot high pressure gas 26 is piped from an output of the compressor 12 to the reaction turbine 36 through the high pressure gas line 28. The reaction turbine 36 includes a drive shaft 40, which is connected to an input shaft 42 of the electrical generator 38 with a coupler 44. The hot high pressurized gas 26 causes vanes of the reaction turbine 36 to rotate the drive shaft 40 and the input shaft 42. Rotation of the input shaft 42 causes the electrical generator 38 to produce electricity for powering the compressor 12 and the evaporator fan 22 through wires 46.

The high pressure liquid 30 exits the reaction turbine 36 and is piped from an output of reaction turbine 36 into the high pressure side input of the expansion device 18 through the high pressure liquid line 32. The expansion device 18 separates a high pressure side of the energy efficient air conditioning system 1 from a low pressure side thereof. One end of the evaporator coil 20 is connected to the low pressure side output of the expansion device 18. Heat from a building or the like is absorbed by the evaporator coil 20. The evaporator fan 22 blows air across the evaporator coil 20 to produce a flow of cold air for a building or the like. The other end of the evaporator coil 20 is connected to a low pressure side input of the compressor 12.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An energy efficient air conditioning system comprising:
a refrigerant gas;
a compressor for compressing said refrigerant gas into a high pressure gas;
a turbine having an input directly connected to an output of said compressor, said turbine expels a high pressure liquid;
an electrical generator is driven by an output shaft of said turbine to produce electrical power;
an expansion device having a high pressure side input connected to an output of said turbine; and
an evaporator coil having an input connected to a low pressure side output of said expansion device, an output of said evaporator coil is connected to a low pressure side input of said compressor.

2. The energy efficient air conditioning system of claim 1 wherein:
said electrical generator provides power for the operation of said energy efficient air conditioning system.

3. The energy efficient air conditioning system of claim 1 wherein:
an evaporator fan for blowing air across said evaporator coil.

4. The energy efficient air conditioning system of claim 1, further comprising:
the high pressure gas is piped from said output of said compressor into said input of said turbine through a high pressure gas line.

5. The energy efficient air conditioning system of claim 1, further comprising:
the high pressure liquid is piped from said output of said turbine into said high pressure side input of said expansion device through a high pressure liquid line.

6. The energy efficient air conditioning system of claim 1 wherein:
said turbine is a reaction turbine.

7. An energy efficient air conditioning system comprising:
a refrigerant gas;
a compressor for compressing said refrigerant gas into a high pressure gas;
a reaction turbine having an input directly connected to an output of said compressor, said reaction turbine expels a high pressure liquid;
an electrical generator is driven by an output shaft of said reaction turbine to produce electrical power;
an expansion device having a high pressure side input connected to an output of said reaction turbine; and
an evaporator coil having an input connected to a low pressure side output of said expansion device, an output of said evaporator coil is connected to an input of said compressor, wherein said evaporator coil absorbing warm air from a confined space.

8. The energy efficient air conditioning system of claim 7 wherein:
said electrical generator provides power for the operation of said energy efficient air conditioning system.

9. The energy efficient air conditioning system of claim 7 wherein:
an evaporator fan for blowing air across said evaporator coil.

10. The energy efficient air conditioning system of claim 7, further comprising:
the high pressure gas is piped from said output of said compressor into said input of said reaction turbine through a high pressure gas line.

11. The energy efficient air conditioning system of claim 7, further comprising:
the high pressure liquid is piped from said output of said reaction turbine into said high pressure side input of said expansion device through a high pressure liquid line.

12. An energy efficient air conditioning system comprising:
a refrigerant gas;
a compressor for compressing said refrigerant gas into a high pressure gas;
a reaction turbine having an input directly connected to an output of said compressor, said reaction turbine expels a high pressure liquid;
an electrical generator is driven by an output shaft of said reaction turbine to produce electrical power for the operation of at least one component of said energy efficient air conditioning system; wherein said reaction turbine replacing a condenser coil and a condenser fan, said electrical generator producing electricity, said energy efficient air conditioning system not requiring electricity to run the condenser fan, the electricity produced by said electrical generator is available to increase the efficiency of said energy efficient air conditioning system;
an expansion device having a high pressure side input connected to an output of said turbine; and
an evaporator coil having an input connected to a low pressure side output of said expansion device, an output of said evaporator coil is connected to an input of said compressor.

13. The energy efficient air conditioning system of claim 12 wherein:
an evaporator fan for blowing air across said evaporator coil.

14. The energy efficient air conditioning system of claim 12, further comprising:
the high pressure gas is piped from said output of said compressor into said input of said reaction turbine through a high pressure gas line.

15. The energy efficient air conditioning system of claim 12, further comprising:
the high pressure liquid is piped from said output of said reaction turbine into a high pressure side input of said expansion device through a high pressure liquid line.

16. A method of retrofitting an existing air conditioning or refrigeration cycle system,
the system comprising:
a refrigerant gas;
a compressor for compressing said refrigerant gas into a high pressure gas;
a condenser coil connected to an output of said compressor;
a condenser fan to cool said refrigerant gas to a high pressure liquid;
an expansion device having a high pressure side input connected to an output of said condenser coil; and
an evaporator coil having an input connected to a low pressure side output of said expansion device, an output of said evaporator coil is connected to a low pressure side input of said compressor;
the method comprising:
replacing the condenser coil and condenser fan with a reaction turbine;
the turbine generating electricity to partially offset the cost of refrigeration and increase efficiency of said system.

* * * * *